US009947209B2

(12) United States Patent
Mu et al.

(10) Patent No.: US 9,947,209 B2
(45) Date of Patent: Apr. 17, 2018

(54) WINDOW ALARM

(71) Applicant: ARMCO KEY SECURITY LIMITED, London (GB)

(72) Inventors: Yang Mu, Guangzhou (CN); ZhenYan Chen, Guangzhou (CN); David Foster, Ipswich (GB); George Schaar, Ipswich (GB)

(73) Assignee: ARMCO KEY SECURITY LIMITED, London (GB)

( * ) Notice: Subject to any disclaimer, the term of this patent is extended or adjusted under 35 U.S.C. 154(b) by 0 days.

(21) Appl. No.: 15/302,613

(22) PCT Filed: Apr. 9, 2015

(86) PCT No.: PCT/CN2015/076143

§ 371 (c)(1),
(2) Date: Oct. 7, 2016

(87) PCT Pub. No.: WO2015/154688

PCT Pub. Date: Oct. 15, 2015

(65) Prior Publication Data

US 2017/0032655 A1 Feb. 2, 2017

(30) Foreign Application Priority Data

Apr. 10, 2014 (CN) ..... 2014 1 0142083

(51) Int. Cl.

| | |
|---|---|
| ***G08B 21/00*** | (2006.01) |
| ***G08B 21/20*** | (2006.01) |
| ***E06B 3/66*** | (2006.01) |
| ***E06B 5/11*** | (2006.01) |
| ***E06B 7/00*** | (2006.01) |
| ***G08B 21/18*** | (2006.01) |

(52) U.S. Cl.

CPC ..... *G08B 21/20* (2013.01); *E06B 3/6612* (2013.01); *E06B 5/11* (2013.01); *E06B 7/00* (2013.01); *G08B 21/182* (2013.01)

(58) Field of Classification Search

CPC ..... G08B 21/20; G08B 21/182; E06B 5/11; E06B 3/6612; E06B 7/00

See application file for complete search history.

(56) References Cited

U.S. PATENT DOCUMENTS

| | | | | |
|---|---|---|---|---|
| 4,350,978 | A | 9/1982 | Riccobono | |
| 2004/0109054 | A1* | 6/2004 | Martin | B41J 11/002 347/102 |

(Continued)

FOREIGN PATENT DOCUMENTS

| | | |
|---|---|---|
| CH | 702416 A2 | 6/2011 |
| CN | 2668804 Y | 1/2005 |

(Continued)

*Primary Examiner* — Erin File

(74) *Attorney, Agent, or Firm* — Robert G. Crouch; Marsh Fischmann & Breyfogle

(57) ABSTRACT

The invention relates to an alarm for detecting damage to a multiple glazed unit comprising: a humidity sensor; and a movement sensor in which, when the movement sensor detects movement of the glazed unit, the humidity sensor compares the current detected humidity in the glazed unit with a previously stored detected humidity, and if the humidity has changed by a predetermined threshold, a damage alarm is triggered.

23 Claims, 6 Drawing Sheets

(56) References Cited

U.S. PATENT DOCUMENTS

| | | | | |
|---|---|---|---|---|
| 2009/0057430 | A1* | 3/2009 | Cherewatti | F24F 11/0015 236/44 A |
| 2013/0278411 | A1* | 10/2013 | DiBella | E05B 63/00 340/527 |
| 2013/0327141 | A1* | 12/2013 | Floyd, Jr. | G01N 33/0063 73/335.02 |
| 2014/0009174 | A1* | 1/2014 | Youssi | G01N 27/223 324/665 |
| 2015/0054413 | A1* | 2/2015 | Chen | H05B 33/0833 315/155 |
| 2015/0293740 | A1* | 10/2015 | Cho | H04N 21/4122 345/1.2 |
| 2016/0232762 | A1* | 8/2016 | Westman | G08B 13/1895 |

FOREIGN PATENT DOCUMENTS

| | | | |
|---|---|---|---|
| CN | 201963149 | U | 9/2011 |
| DE | 102006046859 | A1 | 4/2008 |
| FR | 2908913 | A1 | 5/2008 |
| GB | 2457102 | A | 8/2009 |
| WO | 2010000082 | A1 | 1/2010 |

* cited by examiner

Fig.3b (left)
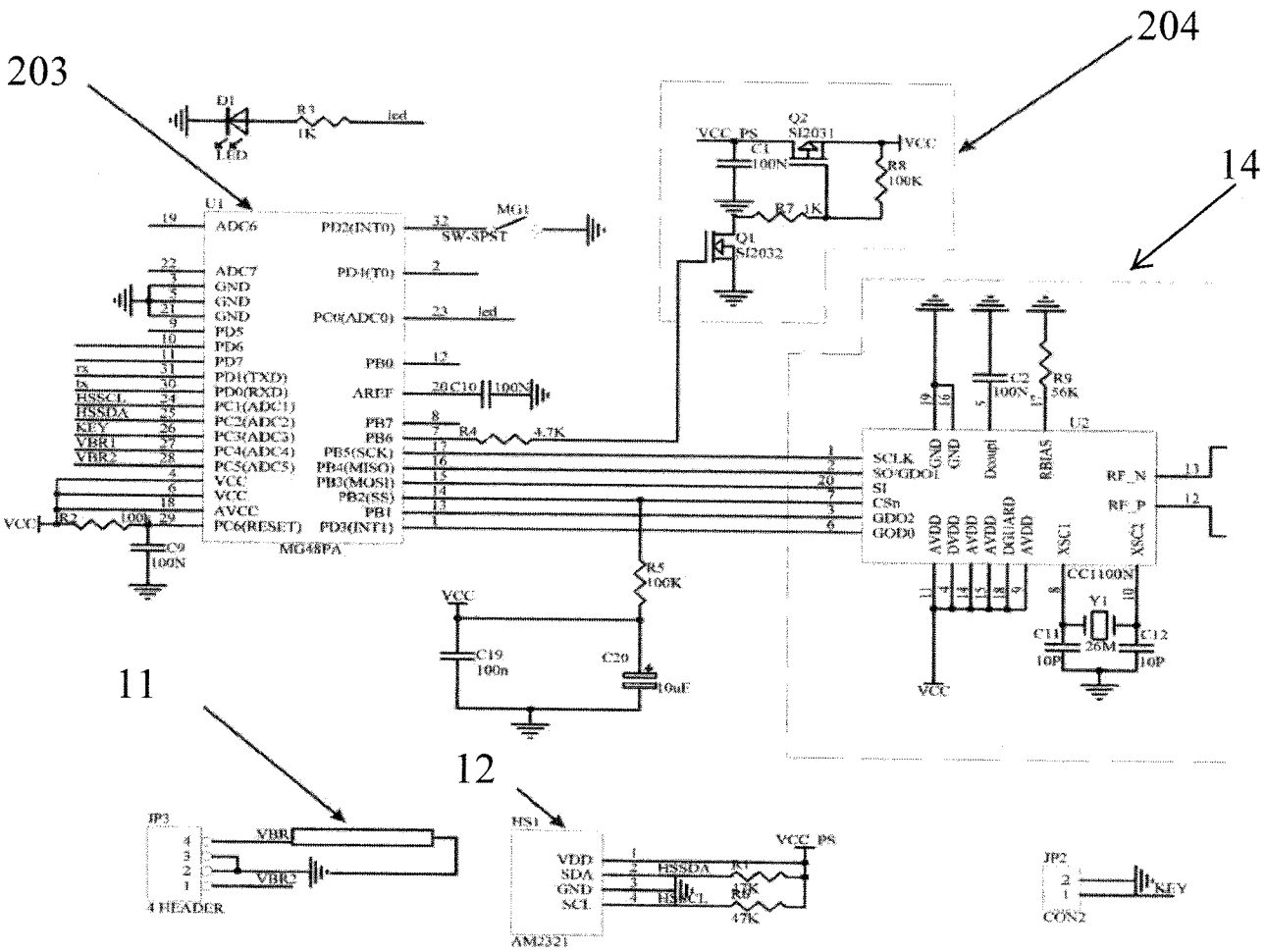

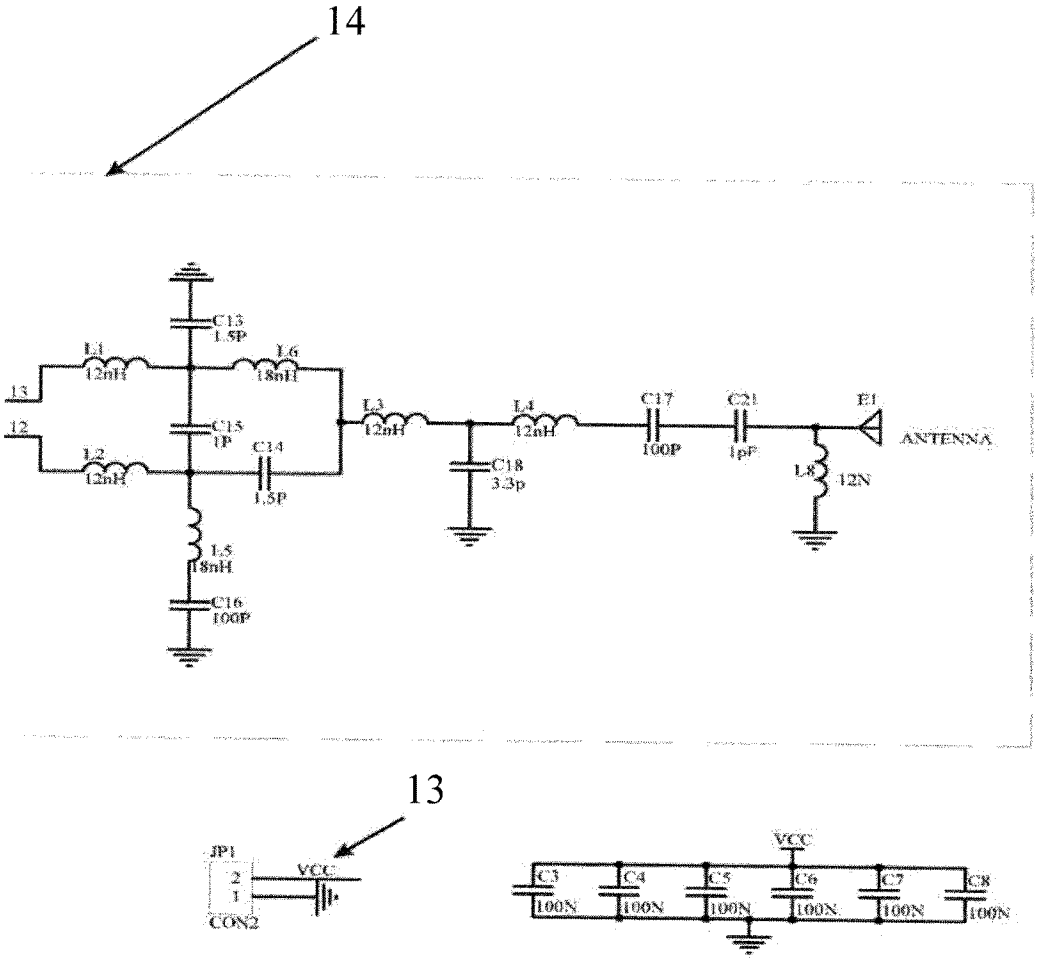
Fig. 3b (right)

WINDOW ALARM

This invention relates to an alarm apparatus, system and method for detecting when a double glazed window unit has been broken.

GB 2457102 describes a wireless pressure sensor alarm for fitting in a double glazed unit. The alarm may be positioned anywhere within a standard rectangular or square unit and will be held in place by adhesive or other fixing means for example. This system detects window breakage by monitoring the pressure within the window unit.

Double-layer/multi-layer glass may be employed in contemporary architectures, advanced doors, windows, and shop windows or glasses, in which an enclosed space is formed, this results in a decrease in heat transfer, and achieves better energy conservation and noise reduction.

Two or more sheets of glass plates are spaced with spacer bars filled with desiccant, to form a sealed space; and the closed space is usually filled up with a mixture of dry air or inert gas. Shop windows, office building windows, glass doors or windows of office buildings and residential housings may suffer from man-made sabotage or intruder-made damage. Double-layer/multi-layer glass doors or windows are a part of daily life, and have rather high associated costs for their maintenance, disassembly and replacement after the damage.

In order to protect such double-layer/multi-layer sealed doors or windows, some alarm systems are generally known. Such alarm system usually includes an alarm apparatus and a controller, wherein the alarm apparatus is provided inside the closed space, and determined whether the closed space is damaged through the detection of absolute humidity or air pressure in the closed space. However, the detection of absolute humidity or air pressure is extremely complex, resulting in high difficulty in production and high cost for the alarm system, and from the detection principle, absolute humidity and air pressure within the sealed window may change with temperature, which may result in incorrect readings. Although there are known alarm apparatuses for detecting relative humidity at present, such alarm apparatuses are physically connected to a controller in a wire mode. These external connections may damage tightness of the closed space, or influence the opening and closing of the door or window, and cause inconvenience in use. Moreover, such alarm systems often have errors in readings, and lower reliability, thereby bringing inconvenience in use to a user.

In view of this, the present invention is directed towards the drawbacks existing in the prior art, and has a main objective to provide an alarm apparatus, an alarm system and a method for monitoring whether a closed space is damaged, which can effectively solve the problems in the existing alarm system such as high difficulty for production, high cost, inconvenience in use, easy damage to the tightness of multi-layer doors or windows, easy occurrence of misjudgment, and low reliability.

According to the invention there is provided an alarm for detecting damage to a multiple glazed unit comprising: a humidity sensor; and a movement sensor in which, when the movement sensor detects movement of the glazed unit, the humidity sensor compares the current detected humidity in the glazed unit with a previously stored detected humidity, and if the humidity has changed by a predetermined threshold, a damage alarm is triggered.

Preferably, the threshold for the change in humidity is determined relative to the difference between the current measured humidity and the previously stored value of the humidity inside the window.

More preferably, the threshold for the change in humidity is at least a 5% change in consecutive humidity measurements.

In one embodiment of the invention, the movement sensor is a vibration sensor. In an alternate embodiment of the invention the movement sensor is an acoustic sensor.

In one embodiment of the invention, the humidity sensor detects the humidity at regular intervals, and stores the detected values in a storage registry. Preferably, said regular interval is between 1 and 2 hours.

Further preferably, said humidity sensor and/or said movement sensor can be adjusted remotely.

Preferably said sensors can send information to an external control unit, and/or said external control unit can send information to said sensors.

Preferably, said external control unit contains said damage alarm, and further preferably said damage alarm is an audio alarm.

According to another aspect the invention there is also provided a pressurised unit comprising: at least two panes of glass sealed to enclose a space; and an alarm as described above.

In a further embodiment of the invention there is also provided a method of detecting breakage of a pressurised unit comprising the steps of: monitoring the unit for any change in movement, monitoring the humidity within the unit, and storing one or more detected humidity measurements; if movement is detected, comparing the current humidity with the previously detected humidity reading, and if the humidity change is greater than a pre-set threshold, transmitting an alarm indicating that the unit has suffered a breakage In a still further embodiment of the invention there is also provided an alarm system for monitoring whether a closed space is damaged, characterized in that, the alarm system includes an alarm apparatus installed wholly inside the closed space, and a controller provided outside the closed space, wherein the alarm apparatus has 2-way communication with the controller in a wireless mode; the alarm apparatus includes a housing, a displacement detection sensor, a power supply control unit, a power supply circuit, a wireless transceiver unit, a humidity sensor for detecting relative humidity, and an MCU operation/storage unit, wherein the displacement detection sensor, the power supply control unit, the power supply circuit, the wireless transceiver unit, the humidity sensor, and the MCU operation/storage unit are all provided inside the housing, and the displacement detection sensor, the power supply control unit, the power supply circuit, the wireless transceiver unit and the humidity sensor are all connected with the MCU operation/storage unit.

Preferably, in said further embodiment the controller includes a signal receiver unit, a power supply unit and a speaker, wherein the power supply unit and the speaker are both connected with the signal receiver unit, and the signal receiver unit is connected in communication with the wireless transceiver unit of the alarm apparatus in a wireless mode.

Further preferably the power supply circuit of the alarm apparatus is powered by a built-in battery or solar power.

Preferably, in said further embodiment the displacement detection sensor is a mechanical shock sensor, a piezoelectric sonic sensor, or a pressure sensor. Furthermore, the housing is preferably a plastic or metal housing.

In a further embodiment of the invention there is also provided an alarm apparatus for monitoring whether a closed space is damaged, characterized in that, the alarm apparatus is installed wholly inside the closed space, and includes a housing, a displacement detection sensor, a power supply control unit, a power supply circuit, a wireless transceiver unit, a humidity sensor for detecting relative humidity, and an MCU operation/storage unit, wherein the displacement detection sensor, the power supply control unit, the power supply circuit, the wireless transceiver unit, the humidity sensor, and the MCU operation/storage unit are all provided inside the housing, and the displacement detection sensor, the power supply control unit, the power supply circuit, the wireless transceiver unit and the humidity sensor are all connected with the MCU operation/storage unit.

According to the invention there is also provided a method for monitoring whether a closed space is damaged, comprising the following steps: installing an alarm apparatus wholly inside the closed space, and providing a controller outside the closed space; then, a displacement detection sensor is used to continuously monitor whether the closed space is displaced or shocked; when the closed space is found to be displaced or shocked, a humidity sensor is activated immediately to detect new relative humidity, and judges whether to give an alarm; and the mode for the judgment is one of the following two modes: an absolute value judgment method: if the current humidity reading exceeds a preset threshold, an alarm is given, or else no alarm is given; and a difference judgment method: if the difference between the current humidity reading and the normal reading recorded previously exceeds a preset threshold, an alarm is given, or else no alarm is given; and while the displacement detection sensor is continuously monitoring whether the protected closed space is displaced or shocked, the humidity sensor detects the relative humidity of the closed space regularly; if the above difference judgment method is used for the alarm judgment, the alarm apparatus must record at least one reading, so as to know the normal humidity reading; and if the above absolute value judgment method is used for the alarm judgment, the alarm apparatus may not record the humidity reading.

DESCRIPTION OF THE DRAWINGS

The present invention will now be described in more detail, by way of example only, with reference to the accompanying figures in which.

SPECIFIC DESCRIPTION

Figure 1:
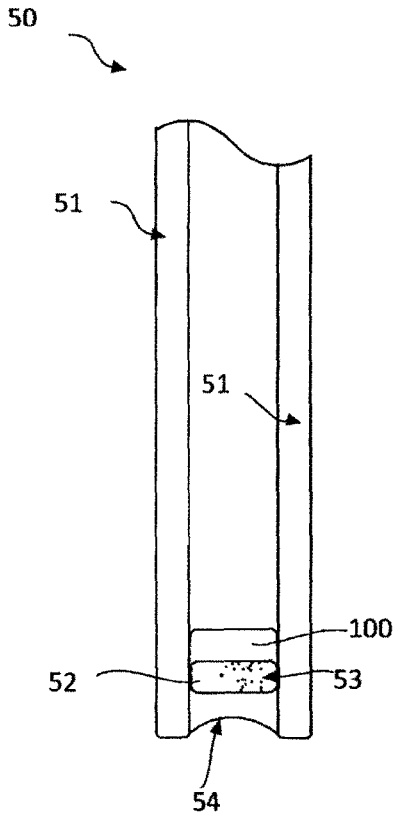
FIG. 1 shows a cross-sectional view of an alarm positioned within a double glazed window.

FIG. 1 illustrates a cross section of part of a side of a double glazed unit 50 in a preferred embodiment, comprising two panes of 4 mm glass 51 which are separated by a spacer 52 partially or completely filled with desiccant 53 and sealed with a silicone seal 54. The space between the panes is preferably in the range 14 mm-28 mm. Alarm unit 100 will typically be located adjacent to the end of spacer bar 53, in the bottom corner of the window to be as unobtrusive as possible.

Double (or even triple) glazed units, often referred to as insulated glazing units, are commonly used in buildings to improve heat insulation by improving the thermal performance of a window in which the unit is installed.

A set of two or more panes of glass are spaced apart and hermetically sealed to form a glazed unit with an air (or gas) space between the planes of glass. It is the air space between the glass layers that provides the insulation. The space between the panes may be filled with air or an inert gas such as argon or krypton which would provide better insulating performance.

Such units may be framed in a sash or frame, for example. Insulating glazed units are often used when replacement windows are required.

Typically the space between the panes is provided with desiccant to prevent condensation and improve insulating performance. In modern double or triple glazed units, most of the air is replaced with Argon or Krypton, which drastically reduces heat transfer through convection and conduction. This is used in the preferred embodiment of the present invention where a unit is first evacuated and then argon is injected to a set concentration which has a pressure substantially different to that of the normal atmosphere.

Figure 2:
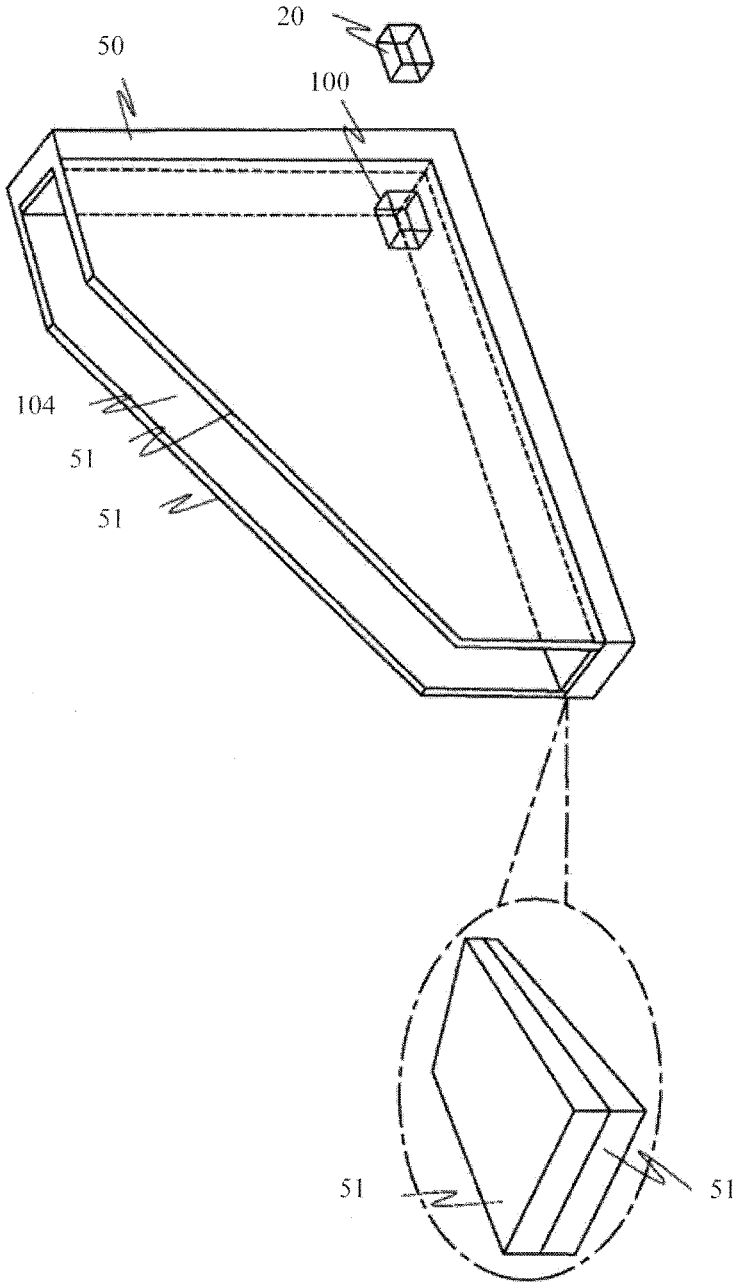
FIG. 2 shows an alternative view of the alarm in the corner of a double glazed window unit.

The alarm unit 100 is usually installed in proximity to the end of the spacer bar 52, located at a corner of the window, so as to efface itself as much as possible. The double-layer sealed glass door/window as shown in FIG. 2 is used to reduce heat/cold loss of a building, and three or more-layer glass windows also have a similar structure and use. In doors or windows with this structure, two or more sheets of glass are spaced apart and sealed with the spacer bar 52, to constitute a certain closed space 104. The closed space 104 has air therein, or is filled with specific gas (for example, argon gas or krypton gas). Such closed space 104 can reduce the heat conduction, thereby reducing heat loss/cold loss of the doors or windows. This type of door or windows can be fixed to different kinds of door/window frames. In some situations, this type of doors or windows are filled with desiccant, which can absorb moisture within the space, so as to reduce humidity within the space, and at the same time can also reduce dewing. A comparable part of this type of doors or windows are filled with argon gas or krypton gas, thereby reducing the heat conduction of the closed space 104 to a larger extent. Air is pumped out during the fabrication process, and inert gas is injected thereto at a preset concentration. In some situations, one or more spacer bars 52 extend along the internal perimeters of the door or window, and combine to constitute a full or partial frame, which is used to space apart the sheet glass 51 from each other. The sheet glass 51 is tightly bonded together with the spacer bar 52, to constitute the closed space 104. The sheet glass 51 is 4 mm in thickness, and the interval between the sheet glass 51 is 14 mm to 28 mm. The spacer bar 52 is fully/partially hollow, and the cavity within the frame bars 102 is sometimes filled with desiccant 53, which is used to absorb moisture remained within the closed space 104, and to avoid dewing inside the sealed glass door and window. The spacer bar 52 is an important component of the sealed glass door or window, and determines, to a large extent, the energy conservation index of the door or window. Generally, the spacer bar 52 is made of aluminum, and may be fabricated into various shapes and dimensions. Of course, the spacer bar 52 may also be made of other metals, plastics, and composite materials.

In such a closed space 104 (a multi-layer closed glass door or window, or other types of closed vessels), because of its isolation from the exterior space, combined with effects of the desiccant and/or the filling gas, the interior relative humidity is different from that of the exterior space. When the closed space 104 is damaged, the alarm unit 100 can sense the change in relative humidity, thereby giving an alarm.

Typically, the spacer bar, 52 (sometimes known as a profile) is a continuous hollow frame that separates the two glass panes 51 in a double glazing window, and is positioned around the entire inner circumference of the window. However, in some cases the spacer bar 52 may alternately only be provided around part of the inner circumference. The spacer bar 52 is bonded to the glass panes via a primary and secondary seal creating an airtight cavity which is filled with air or gas. The spacer bar 52 itself is typically filled with a desiccant to absorb any residual moisture within the cavity and thus prevent condensation within the double glazing window. Spacer bars 52 are an important contributor to a double glazing window's energy ratings. Typically, spacer bars 52 made from aluminium are currently the most commonly used in standard double glazing windows. Aluminium is a light but strong material and the flexibility of spacer bars made from Aluminium means that they can be formed into a wide variety of shapes and sizes. Of course, the spacer bars 52 may be made of other materials such as plastic or different types of metal.

Although this invention is described with reference to double glazed units it will be appreciated that any sealed unit having an internal pressure or humidity different from (i.e. either greater than or less than) an external pressure or humidity such as atmospheric pressure may be used in the present invention. It particular, the alarm is also suitable for use in triple glazed units, or other multiple glazed units.

Typically, an intruder alarm 100 is positioned between two perpendicular spacer bars 52 for insertion into the window between the two panes of glass, in a corner of a double or triple glazed unit 30, as shown in FIG. 2. Alternatively, the alarm unit 100 may simply rest on top of the spacer bar, to be positioned in the corner of the window (thus being relatively unobtrusive). Typically, spacer bars 52 are made from aluminium, but they may be made of other materials. The alarm 100 may be provided with additional securing means (not shown) to fix the alarm 100 to the interior of the window, or may be fixed with adhesive, or other securing means to hod the alarm 100 in position within the window.

In the preferred embodiment of the invention, the alarm 100 is substantially rectangular and measures approximately 130 mm×20 mm×31 mm. However these measurements are only examples, and any particular part of the alarm, may be longer or shorter than described. In this way, the intruder alarm 100 is relatively unobtrusive when installed during manufacture of a standard double glazed unit. Of course, the alarm unit may be differently shaped, for example if it is to be fitted into a double or triple glazed unit that is not a standard rectangular unit, then the alarm unit may be shaped to have a similar profile to the window it is to be fitted into, and may only be provided with a single locating arm, again, that extends from one end of the alarm and is shaped according to the profile of the window, and the spacer bar into which it will be inserted.

Preferably, the alarm 100 is made from plastic but may alternatively be made from other materials such as metal or example.

Figure 3A:
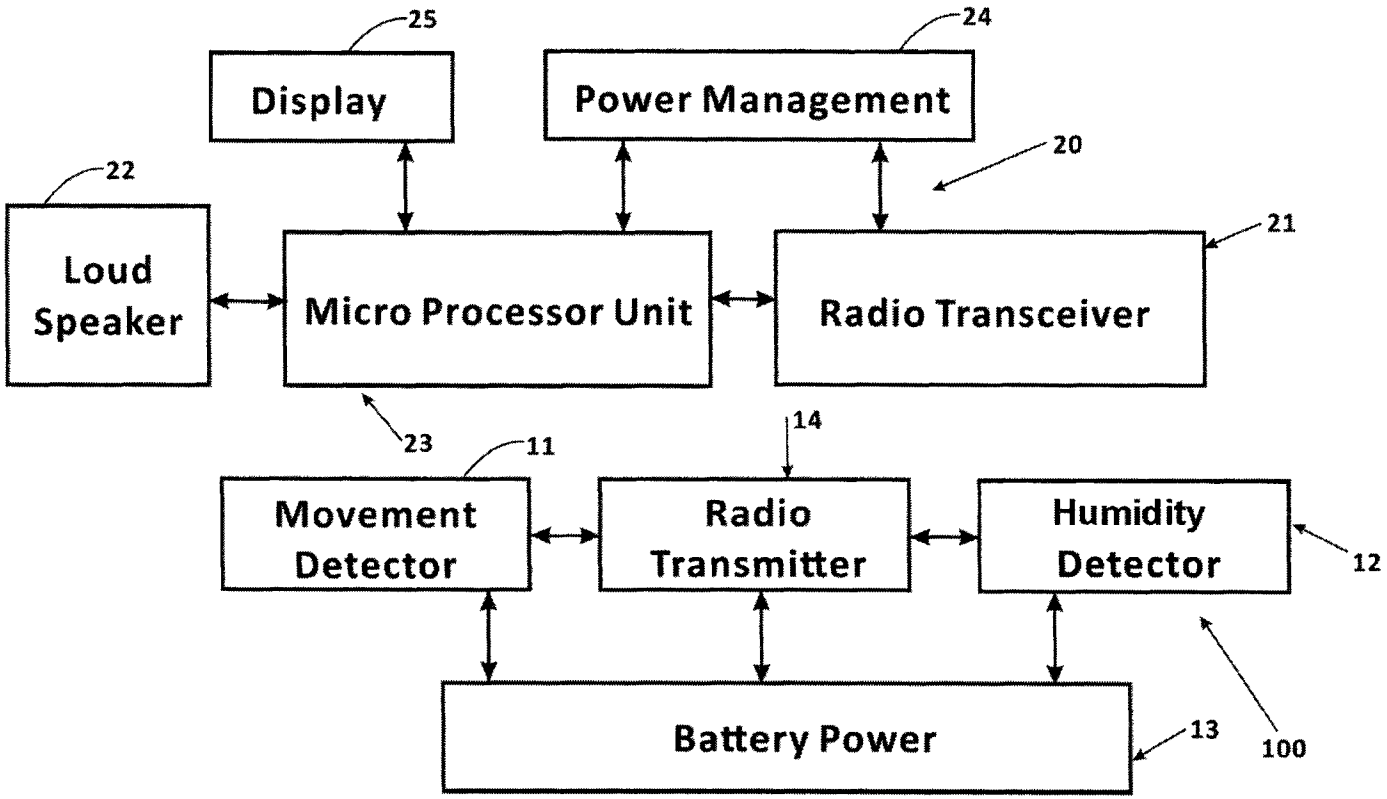
FIG. 3*a* is a schematic diagram of the window alarm unit and external control unit FIG. 3*b* (left) and 3*b* (right) is a circuit diagram of the window alarm unit.

FIGS. 3*a* and 3*b* show schematic diagrams and a circuit diagram of the interior part 10 of alarm 100 to be positioned within the window and a schematic diagram of the interior of an external control unit 20, which may be positioned at a different position within the window, in the same room as the window, or in a separate room that may be dedicated to building control for example. In some embodiments of the invention, the control unit 20 may be provided by a program within a computer for example, or on some other electronic device such as a tablet.

FIGS. 3*a* and 3*b* shows that interior part 10 of alarm 100 has a movement detector 11, a humidity detector 12 with associated clock means (not shown) and storage means (not shown). In some embodiments of the invention the two detectors may be provided with switches, but they may alternatively operate in such a way that a switch is not necessary, for example if the movement detector is an ultrasonic sensor. The detectors 11, 12 are both connected to a power supply 13 and a radio transmission unit 14. Physically, the two detectors are in parallel, but logically they operate in series. This means both detectors are physically connected to the power supply and transmission unit, but in operation, the alarm takes reading from the movement detector 11, and then from the humidity detector 12 (this is described in more detail with reference to FIG. 4). Typically, the humidity detector 12 is a relative humidity sensor, but in some embodiments of the invention an absolute humidity sensor may be used. Preferably the movement detector 11 is a vibration sensor, but it may alternately be an acoustic sensor, or any other type of sensor that can sense movement, such as a mechanical shock sensor, a piezoelectric sonic sensor, a pressure sensor, External control unit 20 comprises a receiver unit 21, a loudspeaker 22, microprocessor unit 23, a power supply and management unit 24, and display unit 25. Preferably the power supply for both the window alarm 100 and the external control unit 25 is a battery, but alternative power supplies may be used such as a solar power supply, or for the external control unit via connection to the mains power supply.

As shown in FIG. 3(*b*) the alarm unit 100 includes a movement sensor 11, a humidity sensor 12 for detecting relative humidity, a power supply control unit 13, a wireless transceiver unit 14, and an MCU operation/storage unit 203 with an internal clock.

The movement sensor 11, the humidity sensor 12, the power supply control unit 13, the wireless transceiver unit 14, the power supply circuit 206, and the MCU operation/storage unit 203 are provided inside the housing; and the movement sensor 11, the humidity sensor 12, the power supply control unit 204, the wireless transceiver unit 14 and the power supply circuit 13 are all connected with the MCU operation/storage unit 203. The housing is made of plastic, metal or other material. The movement sensor 11 is a mechanical shock sensor, a piezoelectric sonic sensor, a pressure sensor, or any other sensors that can detect displacement/shock. The humidity sensor 12 detects relative humidity, such as a capacitive humidity sensor for detecting relative humidity. The alarm unit 100 is installed wholly inside the closed space 104, such that on the one hand, it will not damage the original tightness of the closed space 104, resulting in better tightness of the closed space 104, and on the other hand, opening and closing of the door or window will not be influenced. The controller 20 is installed at other position outside the door or window, for example, in the same room with the door or window, or in another room. The controller 20 may also have data connection with a computer or other electronic devices, such as a tablet computer, through extension, and then output an alarm through a relevant program, so long as the controller 20 can maintain unobstructed communication with the alarm unit 100.

Figure 4:
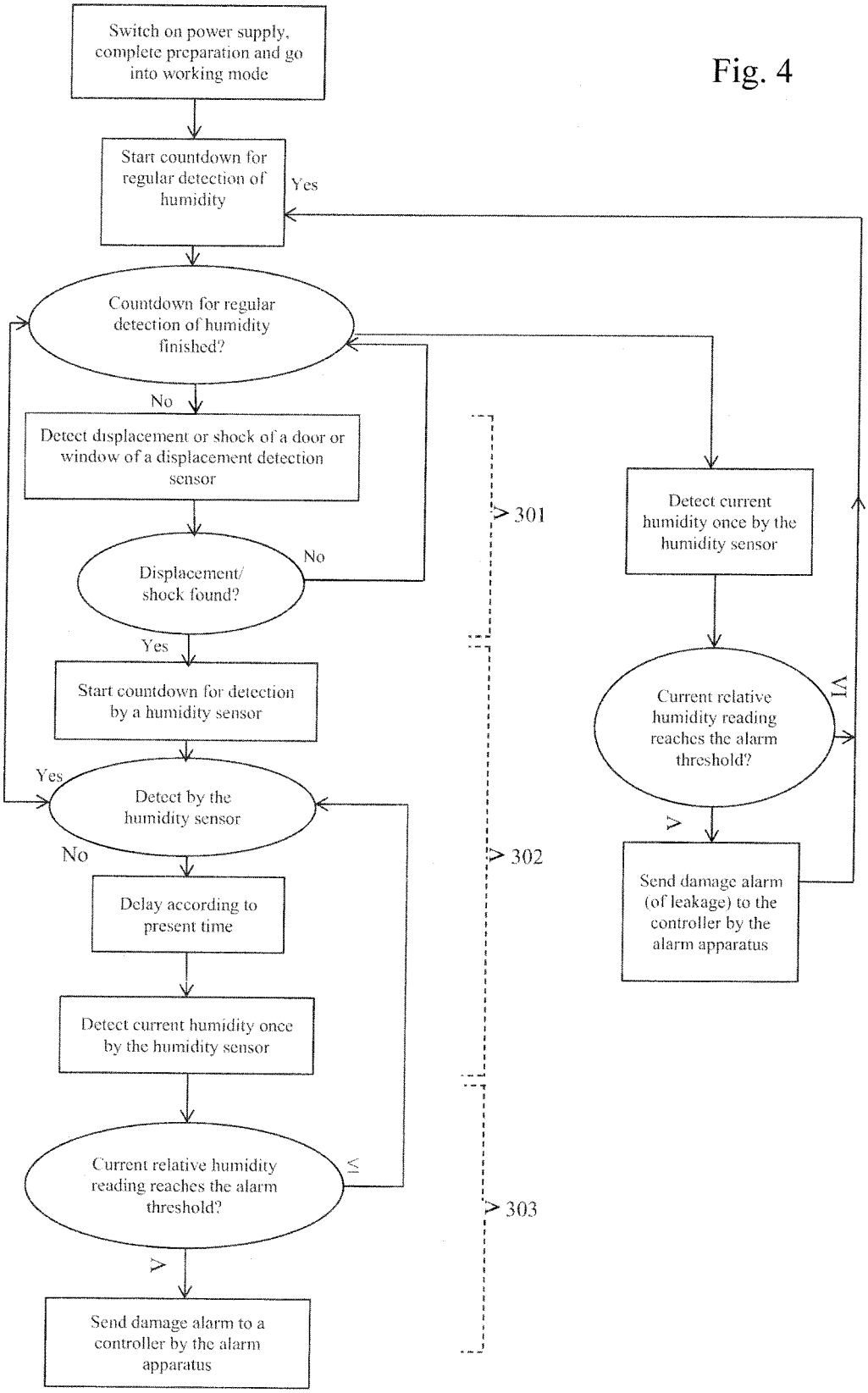
FIG. 4 is a flow diagram showing operation of the alarm

FIG. 4 shows the operation of the alarm 100 once it is positioned in the window and set to be operational.

The alarm message will be received at receiver unit 21 of external control unit 20, and an audible alarm will be transmitted by loudspeaker 22. Preferably, the alarm 100 and the external unit 20 are remote from each other, and the message is transmitted between transmitter 14 and receiver 21 wirelessly. However, in alternative embodiments of the invention the alarm 100 and external control unit 25 may be physically connected. In this embodiment of the invention the alarm is signalled by the loudspeaker 22. However, in alternative embodiments of the invention the alarm may be signalled by other means. For example, the receiver 21 may activate a visual alarm on the display means 25, or a computer monitor for example, or may send an SMS message to the occupant of the building or specific designated telephone number, or the building control manager, or to any other designated person, As shown in FIG. 4, relative humidity readings are detected by the humidity sensor 12 at intervals (generally, the interval may be set as 2 to 24 hours), and the readings within a recent period of time may be stored in a storage unit, for example, humidity readings acquired within the last 12 hours, 24 hours, 1 week, 1 month, 3 months, and the like may be stored. These stored readings may be used over the long term to track and monitor the state of the door or window, and they can be analysed to determine whether the door or window is in good tightness by observing changes in humidity within a period of time. This has a great effect on the fields of maintenance of the door or window, security and protection, energy conservation, and intelligent buildings. For example, if the humidity reading changes gradually and slowly, the door or window may be damaged in tightness or is leaking.

The current relative humidity reading is judged by the MCU operation/storage unit 203. If the current reading is less than or equal to a preset threshold, or a result obtained by subtracting a reading record from the current reading is less than or equal to a preset threshold, the next detection at the next time is waited for; and if the current reading is greater than a preset threshold, or a result obtained by subtracting a historical reading from the current reading is greater than a preset threshold, the sealed window is judged by the MCU operation/storage unit 203 to be leaked, and the wireless transceiver unit 14 is commanded to send a report of the leakage to the outside controller 20.

In step 301, displacement or shock of the door or window is monitored by the movement detector 11. If no displacement/shock is detected, monitoring is kept up all the time; and if displacement/shock is detected, the movement detector 11 notifies the MCU operation/storage unit 203, and activates the humidity detector 12. Typically, the movement detector 11 is in a dormant mode until movement is detected. Once movement has been detected the detector 11 is fully activated to take further readings. If the movement detector 11 does detect movement, then the process proceeds to step 302.

In this step, the current humidity is detected once by the humidity detector 12 at intervals (usually set as 4 seconds) within a set period of time (usually set as 10 to 30 seconds). Then the comparison in step 303 is performed.

In step 303, the current humidity reading is compared with the stored humidity reading recorded by the MCU operation/storage unit 203. If the current reading is less than or equal to a preset threshold, or a result obtained by subtracting the reading record from the current reading is less than or equal to a preset threshold, return to step 302 to continue with the detection; and if the current reading is greater than a preset threshold, or a result obtained by subtracting a historical reading from the current reading is greater than a preset threshold, a damage alarm is judged by the MCU operation/storage unit 203, and the wireless transceiver unit 205 is commanded to send a messages of the damage alarm to the outside controller 20. If the humidity reading is not higher than the previous reading by a predetermined threshold, then the humidity sensor 12 will return to dormant mode and the operation of the alarm will return to step 301, with the movement detector 11 monitoring for movement of the glazed unit.

Typically the predetermined threshold is set to be a % difference relative to the previously stored humidity reading, in a preferred embodiment of the invention the threshold is 5%. However, this threshold can be adjusted according to the exterior weather conditions. In addition, the threshold can be controlled externally, with the new threshold transmitted wirelessly to the alarm 100. Eventually, when the difference between two consecutive humidity readings is greater that the pre-determined threshold as discussed above, the transmission unit 14 will transmit an alarm message to external control unit 20. An alarm will only be transmitted to the external control unit if the movement detector 11 and the humidity detector 12 both detect a change in movement and in humidity. If only one of the sensors detects a change then no alarm will be transmitted although initially a notification message will be sent to indicate to the control unit that an anomaly has been detected and that further testing is taking place.

Only if a significant change in the environment is detected by both the movement detector 11 and the humidity detector 12, a damage alarm is given; and if the change is detected by only one sensor, the damage alarm is not given, but the other sensor is possibly activated to further verify the detection, and at the same time a related prompt message may be sent to the controller 20.

The controller 20 receives the alarm message through the signal receiver unit 21, thereby carrying out the next step of processing. After the alarm is given, the speaker 22 usually sends out caution, and can send out an alarm prompt through other routes, for example, the controller 20 can activate an alarm icon on the computer by extensional connection with a computer, or send out an SMS note by extension with a module of communication functions, or dial a preset phone number, or send out a message to a remote server and/or APP through the network by extension with a network link module.

The alarm unit 100 and the controller 20 are separated from each other, and have 2-way wireless communications through the transmitter 14 and the signal receiver unit 21. Likewise, the controller 20 sends messages or instructions to the alarm unit 100 through the wireless communication, wherein these messages or instructions include, but are not limited to, setting or changing the alarm threshold value of humidity, setting or changing the time parameter in the work flow, setting or changing the mode for storing the humidity readings, and setting or changing the content and mechanism of the wireless communication. Likewise, the alarm unit 100 may also send the messages of the movement detector 11 and the humidity detector 12 to the controller 20, and the controller 20 can also store such messages likewise.

Additional relative humidity sensors may be placed in neighbouring environment to detect relative humidity readings of the atmosphere. Referring to these readings, controller 20 can reasonably adjust the setting of various parameters of the alarm unit 100.

The design emphasis of the present invention consists in that, through the provision of the wireless transceiver unit, it is realized that the alarm apparatus has 2-way wireless communication with the controller, in place of the traditional wire mode, to not damage the original tightness of the closed space, to make the tightness of the closed space better, and to not influence opening and closing of a door or window; and at the same time, through the coordinated provision of the movement detector 11 and the humidity sensor 12: the movement detector 11 is used to monitor whether the protected closed space is displaced or shocked, when the closed space is found to be displaced or shocked, the humidity sensor 12 is activated immediately to detect new relative humidity, so that on the one hand, power consumption of the device can be reduced, difficulty in production of the device is low, and the cost is low, and on the other hand, occurrence of misjudgment can be avoided effectively, reliability can be improved greatly, thereby bringing convenience in use to a user.

Also, in some embodiments of the invention, the external control unit 20 may also transmit information or instructions (wirelessly or otherwise) to the alarm 100. This information/instructions may include details of or changes to the thresholds for the movement/humidity sensors; changes to the operational timing of the sensors; changes to the requirements for storage of the measured results; requests for stored information to be transmitted from the alarm 100 to the external control unit 20 in a particular format or at a defined rate, or for a defined period. Similarly, the movement sensor 11 and/or the humidity sensor 12 may also transmit information to the external control unit. The control unit 20 may also be provided with a storage means to store information from the movement sensor 11 or the humidity sensor 12. An additional humidity sensor (relative or absolute) may also be installed in an additional external control unit that may be located external of the building being monitored, to monitor the external atmospheric conditions and may be used to alter the thresholds within the alarm 100, in response to changes in the external atmospheric conditions.

Other variations and modifications will be apparent to the skilled person. Such variations and modifications may involve equivalent and other features that are already known and which may be used instead of, or in addition to, features described herein. Features that are described in the context of separate embodiments may be provided in combination in a single embodiment.

Conversely, features that are described in the context of a single embodiment may also be provided separately or in any suitable sub-combination.

It should be noted that the term "comprising" does not exclude other elements or steps, the term "a" or "an" does not exclude a plurality, a single feature may fulfil the functions of several features recited in the claims and reference signs in the claims shall not be construed as limiting the scope of the claims. It should also be noted that the Figures are not necessarily to scale; emphasis instead generally being placed upon illustrating the principles of the present invention.

The invention claimed is:

1. An alarm for detecting damage to a multiple-glazed window unit the alarm comprising:

a humidity sensor positioned between panes of glazing in the multiple-glazed window unit; and a movement sensor positioned between panes of glazing in the multiple-glazed window unit;

wherein when the movement sensor detects movement of the multiple-glazed window unit, the humidity sensor compares the current detected humidity in the multiple-glazed window unit with a previously stored detected humidity, and if the humidity has changed by a predetermined threshold, a damage alarm is triggered.

2. The alarm according to claim 1 wherein the threshold for the change in humidity is determined relative to the difference between current measured humidity and the previously stored value of the humidity inside the glazed window unit.

3. The alarm according to claim 2 wherein the threshold for the change in humidity is at least a 5% change in consecutive humidity measurements.

4. The alarm according to claim 2 wherein the humidity sensor is a relative humidity sensor.

5. The alarm according to claim 2 wherein the movement sensor is a vibration sensor.

6. The alarm according to claim 2 wherein the movement sensor is an acoustic sensor.

7. The alarm according to claim 1 wherein the threshold for the change is humidity is at least a 5% change in consecutive humidity measurements.

8. The alarm according to claim 7 wherein the humidity sensor is a relative humidity sensor.

9. The alarm according to claim 1 wherein the humidity sensor is a relative humidity sensor.

10. The alarm according to claim 1 wherein the movement sensor is a vibration sensor.

11. The alarm according to claim 1 wherein the movement sensor is an acoustic sensor.

12. The alarm according to claim 1 further comprising a power supply.

13. The alarm according to claim 12 wherein the power supply is a battery.

14. The alarm according to claim 13 further comprising a Photo Voltaic Cell to maintain battery charge.

15. The alarm according to claim 1 wherein the humidity sensor detects the humidity at regular intervals, and stores the detected values in a storage registry.

16. The alarm according to claim 15 wherein said regular interval is between 1 and 2 hours.

17. The alarm according to claim 1 wherein said humidity sensor and/or said movement sensor can be adjusted remotely.

18. The alarm according to claim 1 wherein said sensors can send information to an external control unit.

19. The alarm according to claim 18 wherein said external control unit can send information to said sensors.

20. The alarm according to claim 18 wherein said external control unit contains said damage alarm.

21. The alarm according to claim 20 wherein said damage alarm is an audio alarm.

22. A sealed or pressurised unit comprising:

at least two panes of glass sealed to enclose a space; and the alarm according to claim 1.

23. A method of detecting breakage of a sealed or pressurised unit, the method comprising the steps of:

monitoring the sealed or pressurised unit with a sensor positioned within the sealed or pressurised unit for any change in movement;

monitoring the humidity with a sensor positioned within the sealed or pressurised unit and storing one or more detected humidity measurements; and if movement is detected, comparing the current humidity with the previously detected humidity reading, and if the humidity change is greater than a pre-set threshold, transmitting an alarm signal indicating that the unit has suffered a breakage.

* * * * *